US007927056B2

(12) United States Patent
Brommer

(10) Patent No.: US 7,927,056 B2
(45) Date of Patent: Apr. 19, 2011

(54) CASING-IN MACHINE WITH BOOK DELIVERY

(75) Inventor: Carsten Brommer, Tecklenburg/Leeden (DE)

(73) Assignee: Kolbus GmbH & Co. KG, Rahden (DE)

( * ) Notice: Subject to any disclaimer, the term of this patent is extended or adjusted under 35 U.S.C. 154(b) by 719 days.

(21) Appl. No.: 11/999,087

(22) Filed: Dec. 4, 2007

(65) Prior Publication Data

US 2008/0138171 A1 Jun. 12, 2008

(30) Foreign Application Priority Data

Dec. 9, 2006 (DE) ..... 10 2006 058 089

(51) Int. Cl.
*B42C 11/04* (2006.01)

(52) U.S. Cl. ..... 412/21

(58) Field of Classification Search ..... 412/5, 22, 412/21

See application file for complete search history.

(56) References Cited

U.S. PATENT DOCUMENTS 2,921,322 A 1/1960 Crawley et al.
5,868,539 A * 2/1999 Rathert ..... 412/5
6,497,544 B1 * 12/2002 Schmucker et al. ..... 412/17
2002/0076304 A1 * 6/2002 Voss ..... 412/5
2006/0140742 A1 * 6/2006 Brommer et al. ..... 412/22

FOREIGN PATENT DOCUMENTS

DE 2016425 A 10/1971
DE OS 20 16 425 10/1971
DE 197 17 736 A1 10/1998
DE 19717736 A1 10/1998
DE 10045801 A 3/2002

* cited by examiner

*Primary Examiner* — Dana Ross
*Assistant Examiner* — Matthew G Katcoff
(74) *Attorney, Agent, or Firm* — Alix, Yale & Ristas, LLP

(57) ABSTRACT

The invention pertains to a book casing device with support plates of a circulation conveyor that transport the books astraddle in a vertical position and with a book delivery unit consisting of a stripping element that is arranged in the plane of motion of the support plates and features a through-opening for the support plates, wherein the downwardly moving books are supported on said stripping element in order to be released from the support plates, and with a delivery device for the subsequent lateral delivery of the books referred to the plane of motion of the support plates. In order to realize a reliable and gentle delivery of the books with high cycle rates, the invention proposes that the delivery unit comprises at least one means for continuously supporting a book while the book is transferred from the stripping position into a delivery position. The books are preferably transferred into their delivery position while being supported by the stripping element.

14 Claims, 4 Drawing Sheets

CASING-IN MACHINE WITH BOOK DELIVERY

BACKGROUND

The invention pertains to a book casing device with support plates of a circulation conveyor that transport the books astraddle in a vertical position and with a book delivery unit having a stripping element that is arranged in the plane of motion of the support plates and features a through-opening for the support plates, wherein the downwardly moving books are supported on the stripping element in order to be released from the support plates, and with a delivery device for the subsequent lateral delivery of the books referred to the plane of motion of the support plates.

A book casing device of the described design with a schematically illustrated book delivery unit is known, for example, from DE-OS 20 16 425. The book blocks are vertically transported from the bottom toward the top astraddle by means of support plates of a circulation conveyor, wherein glue is simultaneously applied on the book blocks that are subsequently provided with a case. During the additional transport, the downwardly moving books reach a delivery device with a drum-shaped stripping element that can be turned back and forward about its longitudinal axis, as well as a delivery rake mounted thereon. The stripping element features a through-slot for guiding through the support plate while the book is stripped off the saddle plate. The books are received from the delivery rake by means of a not-shown tilting element that is arranged on the stripping element, namely due to the rotational movement of the stripping element, and then deposited on a delivery conveyor.

DE 197 17 736 A1 describes a book delivery unit, in which the stripping element is fixed in the through-position for the support plates and the depositing rake can be pivoted relative to the stripping element. The movement of a delivery unit that serves as the tilting element is synchronized with the movement of the support plates in such a way that the book is tilted toward the depositing rake from its vertical position when the through-opening is closed by the support plate.

In the known book delivery systems, the books are quasi pushed over from their vertical position. The depositing rake absorbs the fall and deposits the books on a continuously moving delivery conveyor in the form of a depositing movement, during which it pivots about an axis extending parallel to the stripping element. This causes freshly cased-in books to be subjected to significant stresses that lead to the deformation of the books and jeopardize the connection produced between the book block and the case. Any occurring relative movements with the stripping element, the depositing rake and/or the delivery conveyor may result in markings on books with sensitive case coverings.

SUMMARY

The invention is based on the objective of developing a book casing device with book delivery of the initially described type which makes it possible to reliably and flawlessly deliver the books from the circulation conveyor with a high cycle rate.

According to the invention, this objective is attained by providing a means for continuously supporting a book and a delivery device that make it possible to transfer the books from the stripping position into a delivery position while they are continuously supported. The books are no longer tilted or pushed over. The books are permanently supported during the delivery from the circulation conveyor without being temporarily released. The book shape is preserved. Due to the gentle treatment, the glue connection between the book block and the case is not jeopardized.

Preferred embodiments of the inventive book delivery unit are defined in the dependent claims.

It is advantageous if the delivery device can be moved back and forward between the stripping position and the delivery position. The delivery device preferably is movable essentially perpendicular to the plane of motion of the support plates such that the books maintain their vertical position and are delivered into a delivery plane that lies parallel to the plane of motion of the support plates.

In order to divide the book flow, two delivery devices may alternately receive the books from the stripping position and respectively transfer the books into delivery positions on opposite sides of the plane of motion of the support plates. In this case, the two delivery devices are preferably arranged at a defined distance from one another on a slide unit that can be moved back and forward.

In a preferred embodiment, the stripping element serves as the means for continuously supporting a book and can be laterally moved to a delivery position. It is laterally moved out of the plane of motion of the support plates while supporting the book deposited thereon.

During the transfer, the books may be laterally supported by supporting rails. As an alternative to the displaceable stripping element, the books may be transferred while they are laterally clamped by the supporting rails only or they are laterally supported and transferred by the supporting rails while being carried by the stripping element. The supporting rails are preferably format-adjustable to the book thickness with respect to a guiding width. They may be realized in a L-shaped fashion and respectively feature a limb that is oriented in the direction of the book height and a limb that is oriented in the direction of the book width such that the sides of the book remain partially exposed for downstream transport means. The supporting rails may be realized such that they can be closed and opened in order to laterally clamp the books during the laterally directed delivery movement.

In order to reduce the speed with which the book is deposited on the stripping element by the support plates, the stripping element may be moved downward at the instant in which the book is deposited thereon.

In one preferred additional development, a book gripper is provided downstream of the book delivery unit in order to turn and transfer the books into a second delivery position, wherein said book gripper can be pivoted about an axis and receives the books from said first delivery position while laterally clamping the books.

In order to realize a defined delivery of the books into the second delivery position, the pivoting axis of the book gripper may be horizontally format-adjustable parallel to itself such that the position of the books can be defined in the horizontal direction, i.e., in the direction in which the book height extends, in order to change, for example, the reference edge when the books are turned from the head or foot to the book center or vice versa.

A defined delivery of the books into the second delivery position can also be realized if the pivoting axis of the book gripper is vertically format-adjustable parallel to itself such that the position of the books can be defined in the vertical direction, i.e., in the direction in which the book width extends, in order to change, for example, the reference edge when the books are turned from the fore edge cut to the book spine or vice versa, wherein the shape of the spine, i.e., a straight or a curved shape, as well as the radius of the curvature, can also be taken into account.

BRIEF DESCRIPTION OF THE DRAWING

The characteristics of one preferred embodiment of the present invention are described in greater detail below with reference to the enclosed drawings, in which.

DETAILED DESCRIPTION

Figure 1:
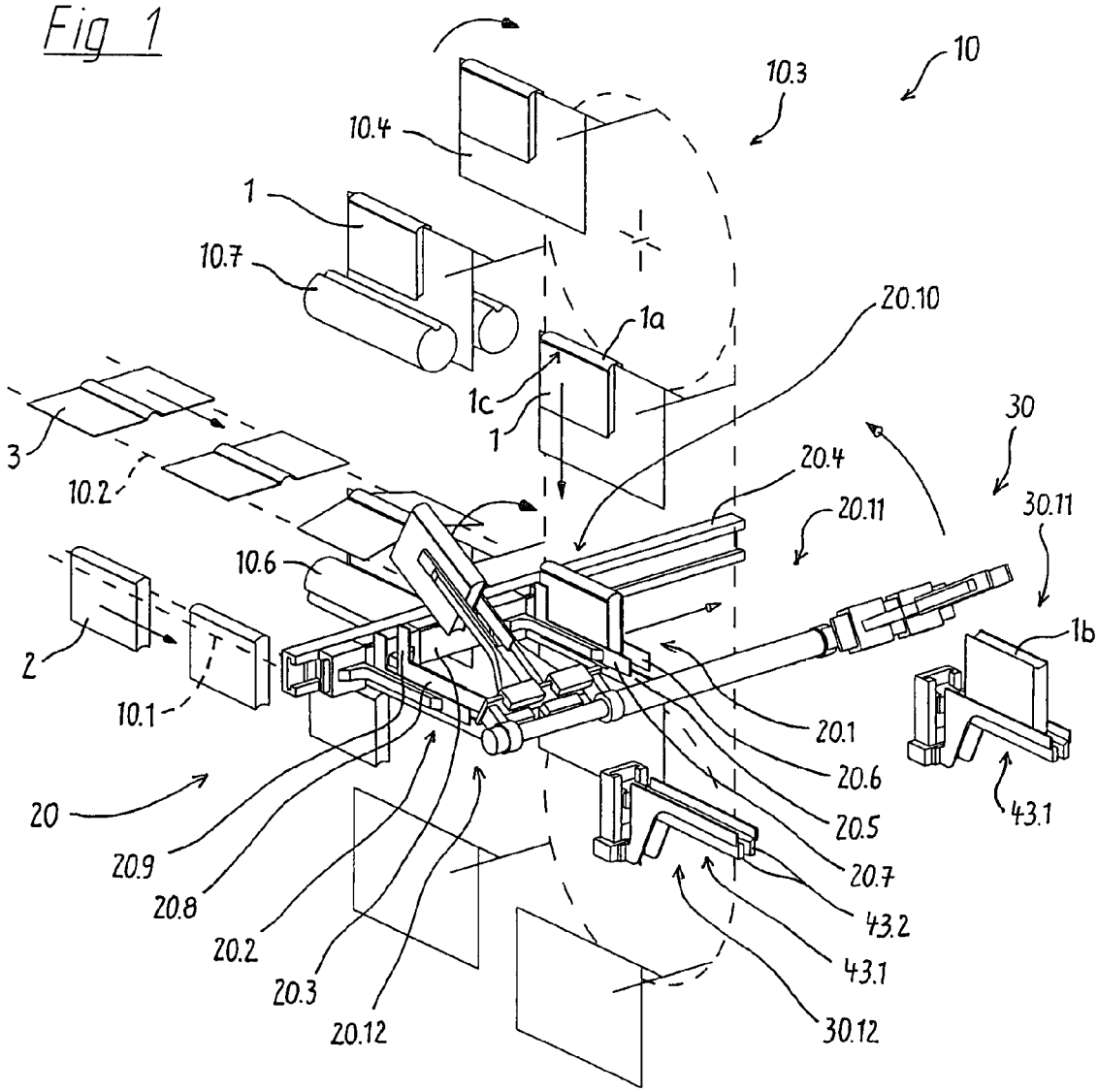
FIG. 1 shows a schematic perspective representation of a book casing device with a book delivery unit and a downstream book gripper, namely in the instant in which the book is stripped off a support plate.

Book blocks 2 and cases 3 are connected into books 1 in the book casing-in machine or device 10. The book blocks 2 are fed to a circulation conveyor 10.3 by a book block transport chain 10.1, wherein said circulation conveyor transports the book blocks 2 astraddle on support plates 10.4 such that they are always positioned vertically. During the vertical transport movement of the book blocks, glue is applied over the entire surface of their end sheets by means of gluing rollers 10.6 and the book blocks are subsequently connected to a case 3 supplied by a case transport unit 10.2. The thusly created books 1 may subsequently also pass through pressing rollers 10.7.

Figure 4:
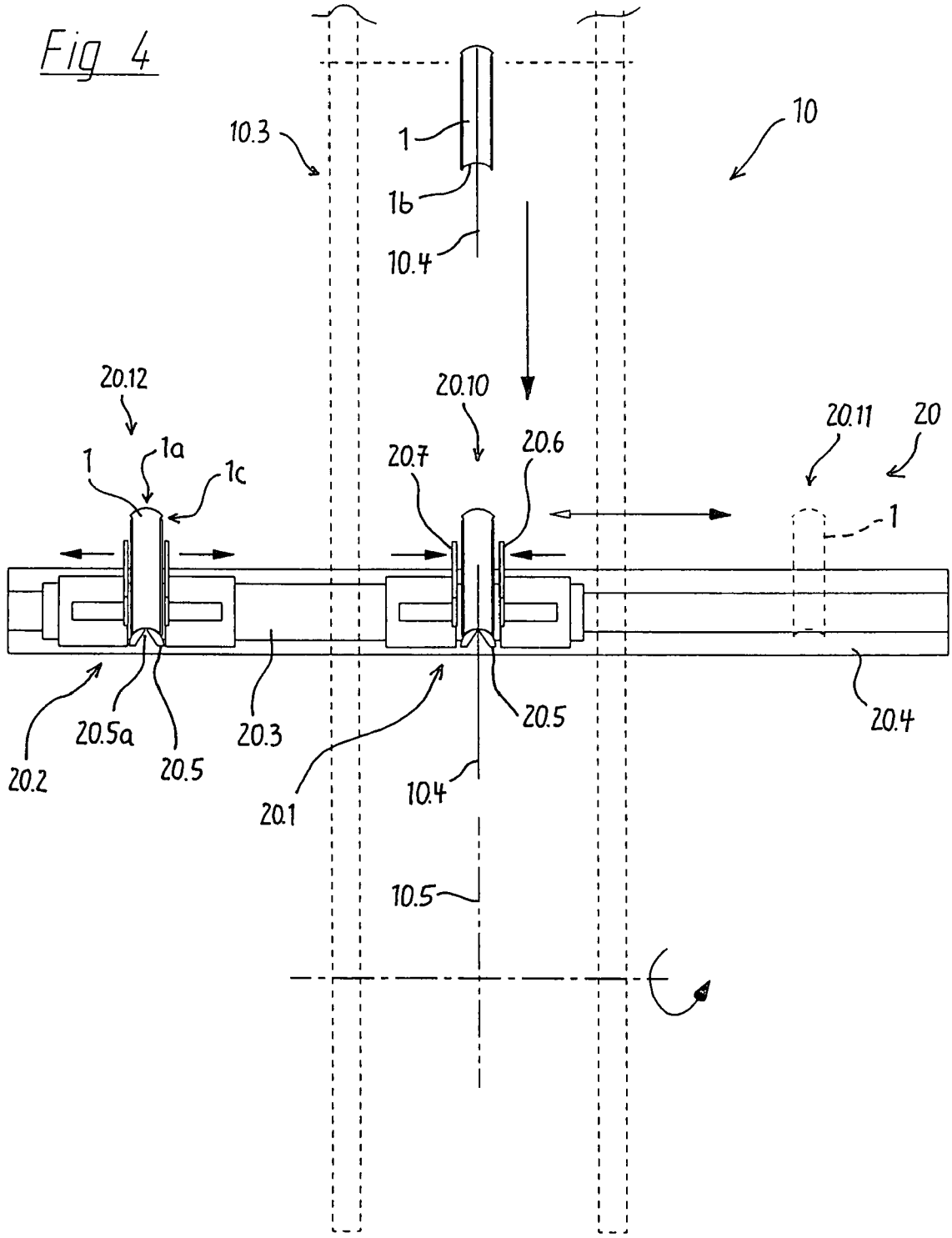
FIG. 4 shows a section through the book delivery unit along the line of section IV in FIG. 3.

During the additional transport, the downwardly moving books 1 reach a book delivery unit 20 that lies in the plane of motion 10.5 of the support plates 10.4, wherein the fore edge cut 1*b* of the books 1 is placed onto a stripping element 20.5 that features a through-slot 20.5*a* for guiding through the support plates 10.4 (see FIG. 4). According to the invention, the book 1 stripped off the support plate 10.4 is now transferred from this stripping position 20.10 into a delivery position 20.11 or 20.12 that is laterally offset referred to the plane of motion 10.5, namely while being continuously supported by supporting means of a book receptacle 20.1 or 20.2, respectively.

In this case, the first means for continuously supporting a book is formed by the stripping element 20.5, on which the book 1 is supported with its fore edge cut 1*b*. This means that the book 1 is no longer pushed down by the stripping element 20.5 as it is the case in the state of the art, but rather moved out of the plane of motion 10.5 of the support plates 10.4 by this stripping element, namely while being supported or carried thereby. For this purpose, the stripping element 20.5 is situated on a slide unit 20.3 that can be moved back and forward perpendicular to the plane of motion 10.5 in a guide rail 20.4 such that the books 1 maintain their vertical position while they are delivered into a delivery plane that lies parallel to the plane of motion 10.5.

In addition to the stripping element 20.5, additional means for continuously supporting in the form of left and right supporting rails 20.6 and 20.7 are provided which are opened to a guiding width that is format-adjustable to the book thickness when the respective book 1 is stripped off the support plate 10.4, wherein said supporting rails are closed to a narrow guiding dimension or with a slight clamping force immediately before the lateral movement of the slide unit 20.3 so as to laterally support the book 1. The required control means are not explicitly illustrated in the figures, but rather only symbolized with motion arrows.

In order to divide the book flow situated in the circulation conveyor 10.3, a first and a second book receptacle 20.1 and 20.2 may alternately receive the books 1 from the stripping position 20.10 and transfer the books into left and right delivery positions 20.11 and 20.12 referred to the plane of motion 10.5. The two book receptacles 20.1 and 20.2 are arranged at a defined distance from one another on a slide unit 20.3 that can be moved back and forward such that the second book receptacle 20.2 is moved from its right delivery position 20.12 into the stripping position 20.10 simultaneously with the delivery stroke of the first book receptacle 20.1 and vice versa.

In order to reduce the speed with which the book 1 is deposited on the stripping element 20.5 by the support plates 10.4, the stripping element 20.5 may be moved downward in the instant in which the book is deposited thereon. According to an alternative embodiment that is not illustrated in the figures, the book 1 to be delivered may be clamped by the left and right supporting rails 20.6 and 20.7 only. This would merely require a single stripping element 20.5 that remains in the plane of motion 10.5 and can be transferred into a lowered position during the delivery of the book 1.

After casing-in the book block 2 into the case 3, the book 1 is usually also pressed in so as to produce a crease-free and permanent glued connection between the end sheets of the book block 2 and the inner pages of the case. This full surface pressing step is carried out on so-called binding-in machines in combination with the joint forming, in which the case joints 1*c* are formed and glued. The books need to be fed into the binding-in machines with the spine 1*a* pointing downward in order to align the spine 1*a* or the book 1 on an alignment table 43.1 formed of prism strips 43.2.

The present book delivery unit 20 is expanded with a double book gripper 30 that makes it possible to transfer the books 1 from the respective left and right delivery positions 20.11 and 20.12 into second left and right delivery positions 30.11 and 30.12, wherein the books 1 are turned and directly deposited on said alignment table 43.1 with their spine 1*a*.

In order to receive the divided book flow, the double book gripper 30 features a left and a right book gripper 30.1 and 30.2 that can be pivoted back and forward about a pivoting axis 30.3 by 180°, namely in a diametrically opposed fashion as symbolized in the figures with corresponding motion arrows. The books 1 are laterally taken hold of by a left and a right clamping jaw 30.4 and 30.5 in a region that is left exposed by the left and the right supporting rails 20.6 and 20.7. For this purpose, the supporting rails 20.6, 20.7 are realized in an L-shaped fashion and respectively feature a horizontally extending limb 20.8 that is oriented in the direction of the book height and a vertically extending limb 20.9 that is oriented in the direction of the book width.

Figure 3:
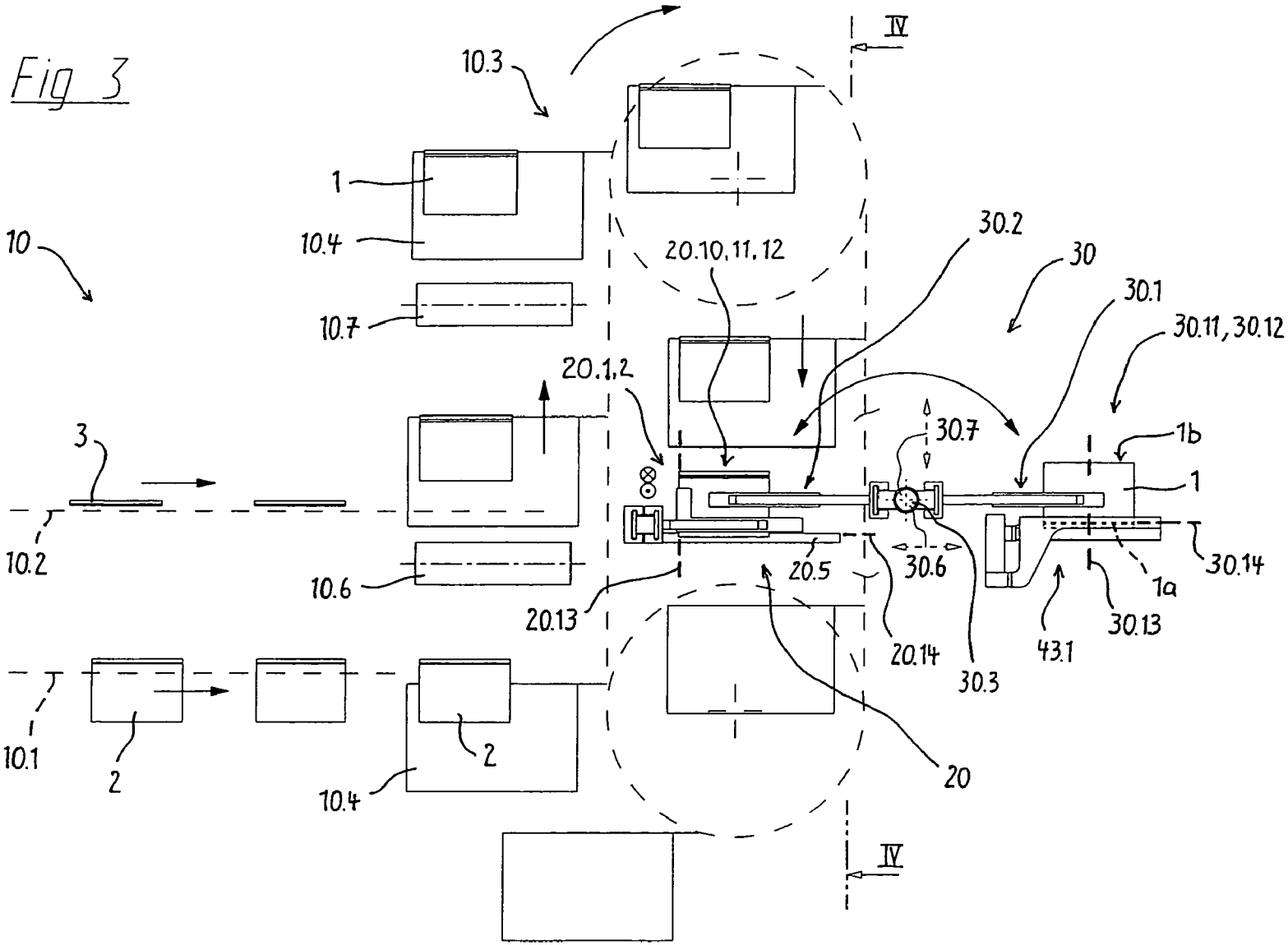
FIG. 3 shows a schematic side view of the book casing device, the book delivery unit and the downstream book gripper.

It is possible to deposit the books 1 on the alignment table 43.1 in a predetermined position with parallel pivot point adjustments 30.6, 30.7 of the pivoting axis 30.3 in the horizontal direction and the vertical direction—as symbolically illustrated with broken double arrows in FIG. 3.

The horizontal pivot point adjustment 30.6 makes it possible to define the position of the books in the horizontal direction, i.e., in the direction in which the book height extends. In the book casing device 10, the books 1 are transported astraddle on the support plates 10.4 with a foot edge 20.13 of fixed format. However, in the binding-in machine, a book center 30.13 of fixed format is desirable such that the books 1 are centrally clamped in the pressing devices. During format changes, this reference edge change can be automated in the form of a corresponding horizontal pivot point adjustment 30.6 in dependence on the respective change in the book height.

The vertical pivot point adjustment 30.7 makes it possible to define the position of the books in the vertical direction, i.e., in the direction in which the book width extends. After being positioned on the stripping element 20.5, the books 1 are delivered out of the book casing device 10 with the fore edge cut 1*b* as fixed reference edge 20.14. However, the books 1 need to be fed to the binding-in machine with the spine 1*a* as fixed reference edge 30.14. During format changes, this reference edge change can be automated in the form of a corresponding vertical pivot point adjustment 30.7 in dependence on the respective change in the book width, wherein the spine shape, i.e., a straight or a curved spine shape, as well as the radius of the curvature, can also be taken into account.

FIG. 1 initially shows the situation, in which a book 1 is supported by the stripping element 20.5 of the first book receptacle 20.1 after it is stripped off the support plate 10.4, wherein a book 1 delivered into the right delivery position 20.12 from the second book receptacle 20.2 is turned into the second right delivery position 30.12 while being gripped by the right book gripper 30.2 of the double book gripper 30. The left book gripper 30.1 simultaneously moves back into the first left delivery position 20.11. It has just deposited a book 1 in the second left delivery position 30.11 on the alignment table 43.1. The slide unit 20.3 with the two book receptacles 20.1 and 20.2 begins a lateral movement that is directed toward the left side.

Figure 2:
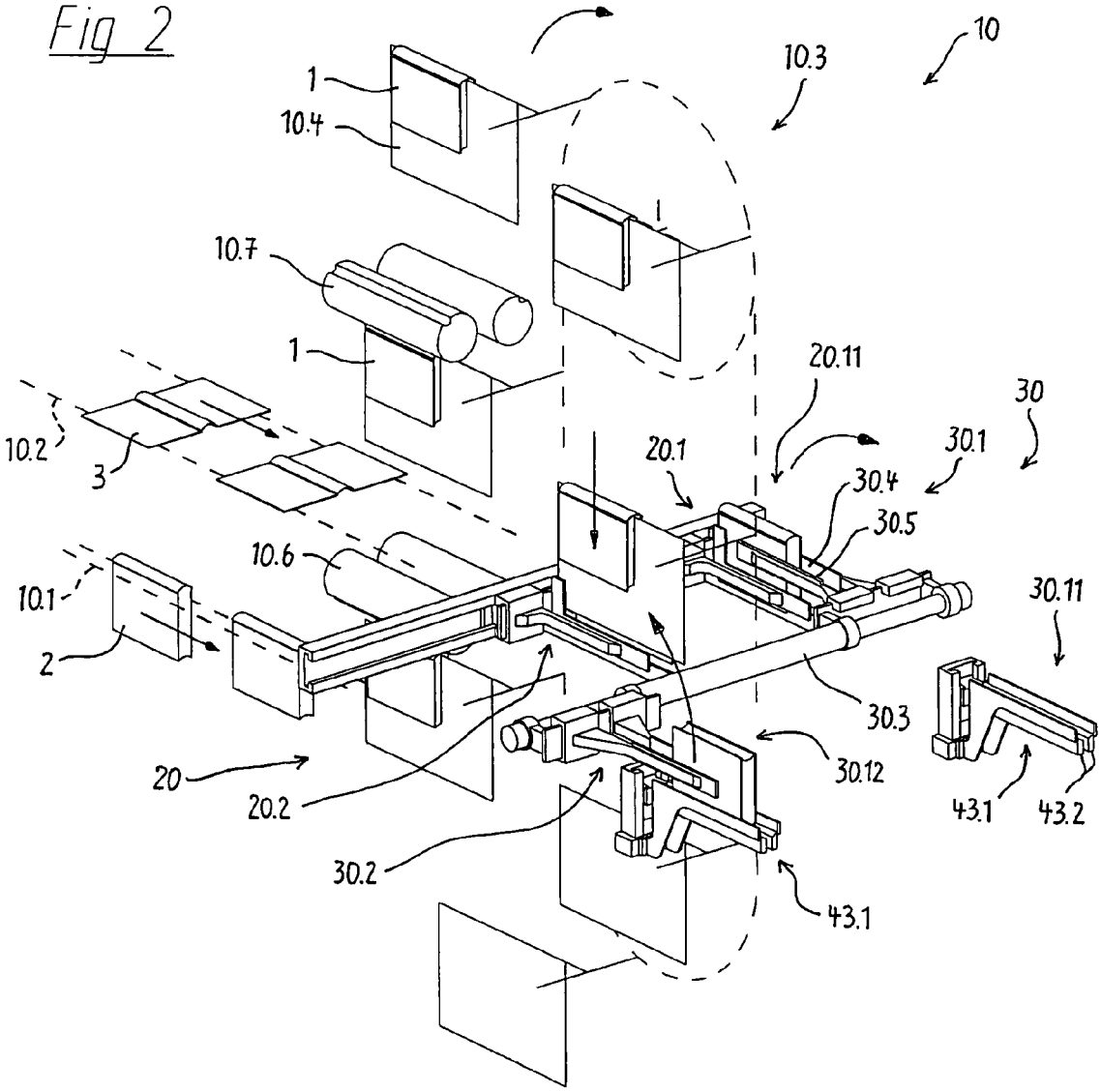
FIG. 2 shows an identical representation of the book casing device with a book that is transferred into a lateral delivery position.

In FIG. 2, the slide unit 20.3 has reached its left end position, namely just in time before the left book gripper 30.1 moves above the book situated in the left book receptacle 20.1 with its opened clamping jaws 30.4 and 30.5 in order to carry out the gripped transfer of this book, namely also just in time before the support plate 10.4 with the book 1 transported astraddle thereon moves between the supporting rails 20.6 and 20.7 or through the through-opening 20.5*a* of the stripping element 20.5 of the right book receptacle 20.2 in order to strip off the book on the stripping element 20.5.

The invention claimed is:

1. A device for casing in a book comprising:

a circulation conveyor having at least one support plate for transporting books astraddle whose movement in the circulation conveyor defines a vertical plane of motion; and a book delivery unit, having (a) a stripping element arranged in the plane of motion of the at least one support plate and having a through opening for the support plate, wherein downwardly moving books in said vertical plane are supported on said stripping element to be released from said at least one support plate, at a location in the device that defines a stripping position;

(b) a delivery device that laterally transports the book relative to the vertical plane of motion, from said stripping position to a delivery position; and (c) means for continually supporting a book while the book is transported laterally to said delivery position.

2. The device of claim 1, wherein said delivery device is movable on a substantially linear path between said stripping position and said delivery position.

3. The device of claim 1, wherein said delivery device is movable substantially perpendicular to said plane of motion for delivering books to said delivery position, which delivery position is in a delivery plane for feeding a binding-in machine and that lies substantially parallel to said plane of motion.

4. The device of claim 1, wherein said delivery device further comprises two book receptacles that alternately receive books from the stripping position and transfer the books into delivery positions on opposing sides of the plane of motion.

5. The device of claim 4, wherein the two book receptacles are disposed at a defined distance from each other on a slide unit so that said book receptacles can be moved back and forth.

6. The device of claim 1, wherein the stripping element continuously supports a book so that said stripping element can be laterally moved out of said plane of motion with the book deposited thereon.

7. The device of claim 1, wherein the means for continually supporting a book comprises two supporting rails that can laterally support a book deposited therein.

8. The device of claim 7, wherein the supporting rails are adjustable to a guiding width associated with a book's thickness.

9. The device of claim 7, wherein each supporting rail comprises a substantially L-shaped unit with one limb of the L associated with the book's height and the other limb of the L associated with a book's width.

10. The device of claim 7, wherein the supporting rails can be closed to laterally clamp a book when laterally moving the book out of said plane of motion and opened to release the book when the book arrives at the delivery position.

11. The device of claim 1, wherein the stripping element is moved downward at substantially the same time that a book is deposited on the stripping element.

12. The device of claim 3, further comprising a book gripper disposed downstream from the book delivery unit, wherein said book gripper receives a book from the delivery position by laterally clamping the book and then pivoting about an axis to transport the book in said delivery plane to a final delivery position for feeding the binding in machine.

13. The device of claim 12, wherein the axis of the book gripper is horizontally adjustable to effect a desired final delivery location of a book.

14. The device of claim 12, wherein the axis of the book gripper is vertically adjustable to effect a desired final delivery location of a book.

* * * * *